United States Patent [19]

Remi et al.

[11] 4,244,761

[45] Jan. 13, 1981

[54] THERMALLY INSULATING SLABS MADE OF REFRACTORY FIBERS FOR THE INSULATION OF FURNACES AND THE LIKE

[75] Inventors: Jean-Pierre Remi; Guy Géhin, both of Bron, France

[73] Assignee: Societe Europeenne des Produits Refractaires, Neuilly-sur-Seine, France

[21] Appl. No.: 940,106

[22] Filed: Sep. 6, 1978

[30] Foreign Application Priority Data

Sep. 9, 1977 [FR] France ..... 77 27298

[51] Int. Cl.[3] ..... E04F 13/20

[52] U.S. Cl. ..... 156/71; 52/408; 156/89; 156/325; 264/30; 428/167; 428/169

[58] Field of Search ..... 428/169, 910, 173, 210, 428/167, 168; 264/30; 156/71, 89, 325; 52/408, 411, 412; 110/336

[56] References Cited

U.S. PATENT DOCUMENTS

| | | | |
|---|---|---|---|
| 2,731,374 | 1/1956 | De Reus | 428/169 |
| 3,042,562 | 7/1962 | Peterson | 428/167 |
| 3,930,916 | 1/1976 | Shelley | 264/30 |
| 4,120,641 | 10/1978 | Myles | 264/30 |

FOREIGN PATENT DOCUMENTS

| | | | |
|---|---|---|---|
| 2094104 | 2/1972 | France | 52/408 |

OTHER PUBLICATIONS

Owens Corning Fiberglas . . . Many Forms for Many Uses, p. 3, 4/1949.

*Primary Examiner*—Stanley S. Silverman
*Attorney, Agent, or Firm*—Watson, Cole, Grindle & Watson

[57] ABSTRACT

The invention relates to thermally insulating materials. It refers to a thermally insulating slab consisting of entangled refractory fibres, the major portion of the fibres being substantially parallel with the main faces of the slab, characterized in that the back of the slab bears a plurality of furrows or grooves distributed over the back. The slab is used for the insulation of furnaces and the like.

5 Claims, 2 Drawing Figures

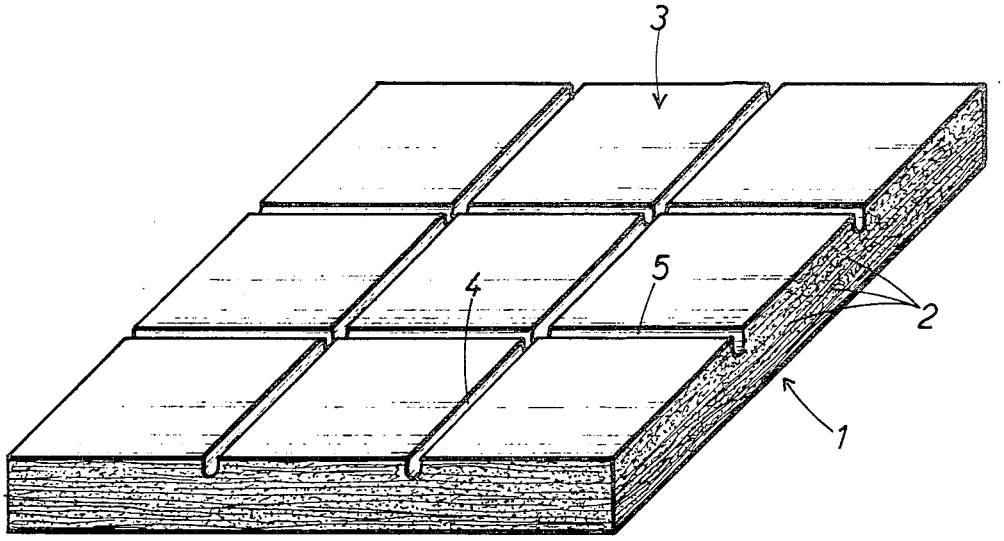
FIG.: 1
FIG.: 2
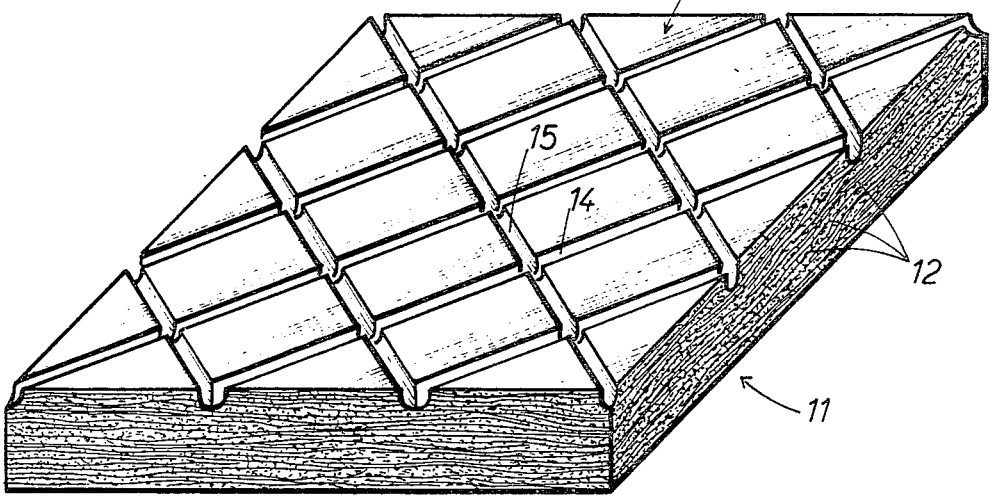

THERMALLY INSULATING SLABS MADE OF REFRACTORY FIBERS FOR THE INSULATION OF FURNACES AND THE LIKE

This application relates to U.S. Ser. No. 943,462, filed Sept. 18, 1978, and commonly owned herewith.

The thermal insulation of furnaces may be carried out in various ways.

The most usual approach involves constructing the hottest zone of the furnace of suitable dense refractory materials and then to insulating such wall from the outside by various layers of rigid or fibrous insulating refractory materials. In certain cases the hottest zone may itself comprise a rigid insulating refractory material.

For old furnaces the problem is often more complex because supplementary external insulation always brings about a reduction of the temperature gradient in the old brickwork and hence an overheating of it which is often incompatible with the qualities of refractory bricks already in position.

One solution involves insulating the hot internal face of such furnaces with a rigid insulating refractory material, and numerous approaches of this type have been made.

Nevertheless they pose some problems since, for example, it is difficult to apply the rigid insulating refractory material to a thickness less than 100 mm if stable brickwork is to be obtained. This would sometimes considerably reduce the volume of the furnace, which renders this technique unusable.

Another solution involves fastening flexible sheets of refractory fibres, several meters long, directly to the internal walls of the furnace. Direct gluing of such sheets being rather difficult, the sheets of fibres are fixed into the brickwork in a mechanical way. Depending on the temperature of the furnace these attachments may be metallic or ceramic. Numerous applications of this type have already been effected, although they are disadvantageous because of the considerable work of preparation required in the furnace itself.

The present invention relates generally to a slab comprising a web of refractory fibres which is easy to attach and exhibits a noteworthy behaviour in use, as well as a method of attachment of this slab.

The invention relates more particularly to a thermally insulating slab comprising entangled refractory fibres, the major portion of the fibres being substantially parallel with the main faces of the slab, characterized in that the back of the slab bears a plurality of furrows or grooves distributed thereover.

Preferably each furrow or groove of rectilinear or curved shape joins two side edges of the slab. A system of furrows or grooves may be designed, for example, which are parallel with one another and are provided at distances of about 50 to 200 mm across the back of the slab. Advantageously, however, two systems of furrows or grooves are employed which mutually intersect, so that the furrows or grooves form on the back of the slab a pattern in the form of squares, rectangles, quadrilaterals, diamonds or triangles, preferably in the form of squares. Again, the distance between two furrows of the same system may be from about 50 to 200 mm. A plurality of furrows in the form of circles or sinusoids may also be employed, but in general furrows of this type would be more complicated to produce and without the advantages of a more simple form.

The width of each furrow or groove must be about 2 mm at a minimum and about 10 mm at a maximum. The depth of each furrow or groove may be from about 2 mm up to about $\frac{2}{3}$ the thickness of the slab.

The dimensions of the slab may vary widely. For example, slabs may be employed of 20×20 cm to 100×100 cm, the thickness of which may vary from 5 to 80 mm.

Of course, the dimensions of the furrows and their spacing will need to be chosen within the ranges indicated above, as a function of the dimensions of the slab, relatively small furrows not spaced far apart being suited to thin slabs of relatively small dimensions, and relatively large furrows spaced far apart being suited to thick slabs of relatively large dimensions, as will be obvious to one skilled in the art.

The entangled refractory fibres constituting the slab are those which are usually employed for manufacturing thermally insulating refractory webs or felts. Fibres may be employed which are obtained, for example, from a mixture of aluminium and silica, or of pure kaolinite, which is melted in an electric furnace, the liquid mixture being then passed in front of a jet of air or steam with the formation of small droplets which thin down into fine fibres. Such fibres are sold in the trade under the brands Kerlane, Fiberfrax, Kaowool and Cerafelt, for example.

Webs or slabs of entangled fibres are in general obtained from these fibres by using paper making techniques for the formation of sheets, or by the direct suction of the fibres at the time of their formation onto a moving belt, as is well known.

The furrows or grooves may be formed on the back of the slab by various means, such as, by cutting the back of a slab with a saw or a cutting off machine. Another means includes forming the furrows or grooves at the time of manufacture of the slab by providing on the suction table patterns in relief which generate the furrows or grooves.

The invention also relates to a method of attachment of the aforedescribed slabs to a solid surface which is to be thermally insulated, in particular to the internal wall of a furnace, which comprises coating the back of the slab, which is provided with furrows or grooves, with a refractory cement, then applying the slab thus coated, the back of the slab being turned towards the surface to be insulated, to said surface to be insulated, and maintaining the slab against the surface until at least a partial setting of the cement.

Refractory cements which are preferred include those having a base of silica, alumina and/or clay and having a mineral binder, such as sodium or potassium silicate, where necessary with the addition of sodium fluosilicate as an accelerator, or phosphoric acid and its derivatives such as aluminium or magnesium phosphate. These cements are well known and available in the trade and will not be further described.

The function of the cement is very important because it serves not only to attach the slab to the surface to be insulated, but that portion of the cement which occupies the furrows or grooves effectively forms a rigid frame for the slab, which after the setting of the cement prevents the usual contraction of the fibres of the slab when they crystallize, this being a crystallization which starts in general at about 950° C. Accordingly, fibre slabs may be employed well beyond their normal maximum temperature of use.

The following description, in relation to the accompanying drawing, given by way of non-restrictive example, will let it be well understood how the invention may be achieved.

FIG. 1 is a perspective view of a slab in accordance with the invention; and FIG. 2 is a perspective view of another slab in accordance with the invention.

In FIG. 1 a square slab 1 is shown comprising entangled refractory fibres 2. The back 3 of the slab bears a pattern in the form of squares, formed by furrows 4 and 5 parallel with the side edges of the slab and intersecting at right angles. The slab is 300×300 mm and has a thickness of 38 mm. The furrows have a width of 5 mm and a depth of 6 mm and are spaced 100 mm apart.

FIG. 2 shows a square slab 11 comprising entangled refractory fibres 12. The back 13 of this slab bears a pattern in the form of squares formed by furrows 14 and 15 parallel with the diagonals of the slab and intersecting at right angles. The slab is 300×300 mm and has a thickness of 50 mm. The furrows have a width of 5 mm and a depth of 10 mm and are spaced about 70 mm apart.

The following non-restrictive examples further illustrate the invention.

EXAMPLE 1

In this example a slab is used which is formed of entangled refractory fibres of kaolin containing 45% $Al_2O_3$, of a size of 30×30 cm, weighing 128 kg/m$^3$, and having a thickness of 2.5 cm. On the back of this slab are four cut grooves which are 3 mm wide and 10 mm deep, two of them being perpendicular to the two others to form a pattern of squares of 10×10 cm. The back of the grooved slab is coated with a cement sold in the trade under the brand "Fixwool-Mod". The composition of this cement is the following: 51–53% $Al_2O_3$, 20–22% $SiO_2$, 4–5% $Na_2O$ (proceeding from the sodium silicate binder), and the remainder, water. This cement exhibits a density after firing of 1.7 and a linear contraction of 0.5–1% after 4 hours at 1200° C. The grooved slab coated with cement is then applied to a sheet of silicon carbide. The slab is tested by heating the entire slab/-sheet to 1300° C. for 24 hours. A contraction of the fibre slab of 1.5±0.5% is observed.

By way of comparison of fibre slab similar to the above slab except that it has not been grooved, is tested by following the same operative method as above. A contraction of 2.5±0.5% is observed.

It is seen that the grooving of the slab in accordance with the invention considerably improves the behaviour of the slab, which enables it to be used at working temperatures higher than its normal limit of use, which lies at about 1150°–1200° C.

EXAMPLE 2

The operative method of Example 1 is followed except that a slab is employed which is formed of refractory fibres of 60% of alumina and 39.5% of silica, available in the trade under the brand Kerlane 60, and the test is conducted at 1500° C. instead of 1300° C. The grooved slab in accordance with the invention exhibited a contraction of 2±0.5%, while the non-grooved reference slab exhibited a contraction of 4±0.5%.

It is seen that the grooving of the slab in accordance with the invention considerably improves its behaviour at high temperatures, which enables it to be used at working temperatures of up to 1500° C., whereas its normal limit of use is at about a 1350°–1400° C. range.

Obviously the embodiment described is only one example and that it would be possible to modify it especially by substitution of equivalent techniques, without thereby departing from the scope of the invention.

We claim:

1. In a process for thermally insulating a solid surface by lining said surface with a plurality of thermally insulating slabs capable of withstanding normal in use temperatures of at least 1000° C., said slabs each comprising entangled refractory fibers with a major portion of said fibers being substantially parallel to opposed surfaces of said slabs, comprising the steps of providing only one of said surfaces of each said slab with a plurality of open grooves in intersecting relationship, coating said one surface with a refractory cement so as to substantially fill said grooves, disposing said one surface toward the solid surface to be insulated, and maintaining each said slab against the solid surface until at least a partial setting of said cement, whereby the cement occupying said grooves effectively forms a rigid frame for each said slab, which after the setting of the cement prevents contraction of the fibers of each said slab upon crystallization beyond a minimum extent, said slabs thereby being capable of withstanding in use temperatures higher than said normal temperatures without fiber contraction beyond said minimum extent.

2. The process according to claim 1, wherein each said groove has a width of from about 2 to 10 mm and a depth of from 2 mm to about two-thirds the thickness of each said slab, and pairs of adjacent ones of said grooves being spaced about 50 to 200 mm apart.

3. The process according to claim 1, wherein said refractory cement includes a base of silica, alumina and/or clay, and has a mineral binder.

4. The process according to claim 1, wherein a first of said grooves extend between a first pair of side edges of each said slab, and a second of said grooves intersect said first grooves at right angles and extend between a second pair of said side edges.

5. The process according to claim 1, wherein the solid surface to be insulated comprises an internal surface of a furnace.

* * * * *